US006126997A

United States Patent [19]

Rivera et al.

[11] Patent Number: 6,126,997

[45] Date of Patent: Oct. 3, 2000

[54] METHOD FOR TREATING MAGNESIUM DIE CASTINGS

[75] Inventors: José B. Rivera, Philadelphia, Pa.; Robert L. McMaster, St. Louis, Mo.; Charles R. Ike, Clarks Green, Pa.

[73] Assignee: Bulk Chemicals, Inc., Reading, Pa.

[21] Appl. No.: 09/243,760

[22] Filed: Feb. 3, 1999

[51] Int. Cl.[7] ..... B05D 3/00

[52] U.S. Cl. ..... 427/307; 427/327; 427/430.1

[58] Field of Search ..... 427/307, 327, 427/430.1

[56] References Cited

U.S. PATENT DOCUMENTS

| | | | |
|---|---|---|---|
| 2,302,939 | 11/1942 | De Long . | |
| 2,335,826 | 11/1943 | George . | |
| 3,061,467 | 10/1962 | Vincent . | |
| 3,378,410 | 4/1968 | Barlett . | |
| 4,370,173 | 1/1983 | Dollman . | |
| 4,780,153 | 10/1988 | Gudhe et al. | 148/6.2 |
| 5,043,022 | 8/1991 | Kosters et al. | 134/3 |
| 5,244,738 | 9/1993 | Seibel | 428/418 |
| 5,393,353 | 2/1995 | Bishop . | |
| 5,451,431 | 9/1995 | Purnell et al. . | |
| 5,578,347 | 11/1996 | Chan | 427/336 |
| 5,634,986 | 6/1997 | Beck | 148/246 |
| 5,645,650 | 7/1997 | Ishizaki et al. . | |
| 5,700,523 | 12/1997 | Petrole et al. | 427/397.8 |
| 5,859,106 | 1/1999 | Jones et al. . | |

OTHER PUBLICATIONS

Technical Note #20—Surface Treatments. (No date).

Murray, R.W. and Hillis, J.E., "Magnesium Finishing: Chemical Treatment and Coating Practices," SAE Technical Paper Series, International Congress and Exposition, Detroit, Michigan, Feb. 26–Mar. 2, 1990.

Hawke, D. and Gaw, K., "Effects of Chemical Surface Treatments on the Performance of an Automotive Paint System on Die Cast Magnesium," SAE Technical Paper Series, International Congress & Exposition, Detroit, Michigan, Feb. 24–28, 1992.

Skar, J.I., Manfred, W., Albright, D., "Non–Chromate Conversion Coatings for Magnesium Die Castings," SAE Technical Paper Series, International Congress & Exposition, Detroit, Michigan, Feb. 24–27, 1997 (Reprinted from: Characteristics and, Applications of Magnesium in Automotive Design (SP–1250).

Chromating of magnesium castings—Process: NH 35 (Norsk Hydro, Magnesium Division). (No date).

Hawke, D., and Albright D.L., "A Phosphate–Permanganate Conversion Coating for Magnesium" (Hydro Magnesium Marketing—Reprinted by permission of the publisher from "A Phosphate–Permanganate Conversion Coating for Magnesium," David Hawke and D. L. Albright, *Metal Finishing*, Oct. 1995, pp. 34–38. Copyright 1995 by Elsevier Science.

Ford Laboratory Test Methods, Salt Spray Resistance Test for Paiunted Panels and Parts, Product and Manufacturing Engineering Staff, May 11, 1990.

*Primary Examiner*—Shrive Beck
*Assistant Examiner*—Jennifer Calcagni
*Attorney, Agent, or Firm*—Ratner & Prestia

[57] ABSTRACT

A method for treating magnesium die castings sufficiently cleans the die castings and improves their paint adhesion and corrosion resistance by utilizing hydroxy acetic acid, among other constituents. The method includes cleaning the castings with an alkaline cleaning solution, rinsing with water, pickling the castings with an aqueous hydroxy acetic acid solution, rinsing with water again, and then contacting the castings with a chrome-free pretreatment. The alkaline cleaning and pickling steps appear to remove substantially all die casting impurities in order to adequately prepare the metal for application of the pretreatment. The chrome-free pretreatment may be an organofunctional silane solution or an aqueous polymeric system having hydroxyl and carboxylic functional groups along with a compound of a group IV-B element. The pretreatment is then painted or contacted with another decorative coating, with no rinsing step occurring between the pretreatment and painting steps. The treatment process attains good paint adhesion and corrosion resistance of the castings while utilizing environmentally friendly constituents.

15 Claims, No Drawings

METHOD FOR TREATING MAGNESIUM DIE CASTINGS

FIELD OF THE INVENTION

The present invention pertains to treating magnesium die castings to improve the corrosion resistance of the castings and to improve the adhesion of subsequently applied decorative finishes, such as paint, to the castings.

BACKGROUND OF THE INVENTION

Magnesium is a versatile metal with many commercial uses and can be worked by practically all known methods. Magnesium can be cast by sand, die, permanent mold, and precision investment methods; extruded into numerous shapes; and rolled (or wrought) into sheet, plate, or strip metal. Most end uses of magnesium require some degree of protection against corrosion and, in end uses which require paint, paint adhesion. Accordingly, a coating which improves the corrosion resistance and paint adhesion of magnesium is often applied to the metal prior to the final paint or other decorative finish is applied. Such coatings are referred to as pretreatments. Prior to the deposition of a pretreatment, however, it is important to sufficiently clean magnesium; otherwise, the poorly cleaned areas will become sources for poor paint adhesion and likely corrosion. In many cases, it has been determined that poor paint adhesion can be attributed to a poorly cleaned specimen, and not to the performance of the pretreatment itself.

In general, there are numerous cleaning methods and baths which have been used to clean magnesium. In their article, "Magnesium Finishing: Chemical Treatment and Coating Practices," Reese W. Murray and James E. Hillis disclose four general cleaning processes of magnesium: mechanical cleaning, solvent cleaning, alkaline cleaning, and acid pickling. This article mentions that these methods can be used singly or in combination. Table 6 of this article lists a variety of acid pickles used in cleaning magnesium, and the selected pickling agent depends on the manner by which magnesium is formed. Only chromic acid is listed as a pickling agent for all forms of magnesium, and an acetic-nitrate combination is disclosed as useful on wrought magnesium (but not castings) to remove mill scale. Mill scale consists chiefly of magnesium oxide and its hydrates, finely divided magnesium metal, and a carbon or carbonized oily lubricant. Mill scale is picked up by the rolled articles of magnesium during working and appears as scattered specs or imperfections in the rolled articles.

U.S. Pat. No. 2,302,939 to De Long discloses the use of either aliphatic carboxylic acid solutions or hydroxy aliphatic carboxylic acid solutions to remove mill scale from the surfaces of rolled articles of magnesium and magnesium-based alloys. Acetic, citric, and tartaric acids are disclosed as particularly effective for removing mill scale. This patent discloses that these organic acidic solutions attack mill scale much more rapidly than they do the magnesium metal, as opposed to the inorganic acids used prior to this patent. The treated magnesium article can then be coated with a protective finish such as a nitrate-chromate bath.

As can be inferred from the above, the selected cleaning method depends on the manner by which the magnesium was formed. The impurities formed during die casting of magnesium can be particularly troublesome and difficult to remove, especially when compared to mill scale. During die casting of magnesium, oxides and hydroxides of magnesium and alloying elements, such as aluminum, are formed on or near the surface of the castings. Furthermore, the lubricants used on the dies themselves are another source of impurities. Collectively, all of the impurities formed during the die casting process and remaining on the surface of the casting, including oxides and hydroxides of magnesium, aluminum, and other alloying elements and the impurities from the lubricants, will be referred to herein as "die casting impurities."

It has traditionally been believed that a relatively caustic (and typically toxic) cleaning agent is required to sufficiently remove die casting impurities, and that a relatively high degree of undesirable etching of the metal surface must be done in order to adequately clean the metal. A problem associated with the use of caustic baths is the disposal of such baths. For example, many sewer treatment authorities carefully regulate the types of baths that can be disposed of through sewers, and caustic acids, such as sulfuric acid, phosphoric acid, hydrofluoric acid, and nitric acid, are often forbidden.

Scott Fairchild, in his article "Technical Note No. 20—Surface Treatments," lists a number of acid pickling treatments for wrought magnesium alloys (Table 7A), for wrought or cast magnesium alloys (Table 7B), and for cast magnesium alloys (Table 7C). A mixture of acetic acid and sodium nitrate is mentioned in Table 7A for wrought magnesium alloys, while most of the pickling agents listed in Table 7C for cast magnesium alloys are more toxic and include sulfuric acid, nitric/sulfuric, chromic/nitric/hydrofluoric, phosphoric acid, and hydrofluoric/sulfuric.

Once cleaned, a pretreatment must then be applied to the magnesium die castings, as mentioned above. Baths containing hexavalent chromium have traditionally been used as coatings to improve the corrosion resistance and paint adhesion of magnesium die castings. Such baths have been used both as pretreatments for subsequent painting and as stand-alone coatings for corrosion protection. Chromium has been recognized as a carcinogen and as a cause of other environmental hazards, however. Accordingly, its use is sought to be minimized for the safety and protection of workers and others nearby. Furthermore, chromium baths often require a final rinse prior to the application of any decorative coating. The disposal of the final rinse bath, as well as the chromium bath itself, is costly.

SUMMARY OF THE INVENTION

The present invention provides a method for treating a magnesium die casting to improve corrosion resistance and paint adhesion of the magnesium die casting by first contacting the metal surface with a first bath which is an alkaline cleaning solution to form a cleaned magnesium die casting. The cleaned magnesium die casting is then rinsed with water to form a rinsed magnesium die casting, which is then pickled, by being contacted with a second bath comprising an aqueous hydroxy acetic acid solution. The pickled magnesium die casting is rinsed with water then pretreated, namely contacted with a third bath which is a chrome-free pretreatment.

According to an embodiment of the present invention, the method further includes the steps of drying the pretreated metal and applying a decorative coating on the dried magnesium die casting, without rinsing between the steps of contacting the rinsed, pickled magnesium die casting with the third bath and applying the decorative coating, such as paint including powdered paint.

The present invention also contemplates the use of hydroxy acetic acid in the process of treating magnesium die castings.

It is to be understood that both the foregoing general description and the following detailed description are exemplary, but are not restrictive, of the invention.

DETAILED DESCRIPTION OF THE INVENTION

The present invention is directed to a method for treating magnesium die castings to improve corrosion resistance and paint adhesion of magnesium die castings. As used herein, the term "treating" shall mean cleaning and applying a pretreatment, and optionally can also include process steps up through painting. Each of these steps—cleaning, pretreating, and painting—all play a role in a final product's ability to resist corrosion and minimize paint loss. Also, a magnesium die casting shall mean any magnesium alloy which has been formed by any known die casting technique. A magnesium alloy shall mean any metallic alloy of which magnesium has the highest content of any other element or a content equal to the highest element. Magnesium alloys for which the method of the present invention is particularly well suited include AZ91 and AM60, among others.

The treatment method is carried out in order in the following stages:

1) Alkaline clean—The metal surface is contacted with a first bath which is an alkaline cleaning solution;
2) Water rinse;
3) Pickling—The metal surface is contacted with a second bath which is an aqueous hydroxy acetic acid solution;
4) Water rinse; and
5) Pretreatment/Final Sealing—The rinsed metal surface is contacted with a chrome-free pretreatment.

In the above steps, each of the baths may contact the metal surface by any known coating technique, including spray, immersion, roll coating, or flow coating techniques. Optionally, after step 5), the metal surface is dried and then a decorative coating is applied, without rinsing between these steps. Thus, the pretreatment is a "dried-in-place" pretreatment.

The alkaline clean stage is effected by contacting the magnesium die casting with a first bath of an alkaline cleaning solution to form a cleaned magnesium die casting. The alkaline cleaning solution is an aqueous solution of an alkaline cleaning agent. Some exemplary alkaline cleaning agents which can be used in connection with the present invention include sodium hydroxide and potassium hydroxide. A potassium hydroxide based cleaning agent sold under the trademark BULK KLEEN™ 835D by Bulk Chemicals of Mohrsville, Pa., has been found particularly effective.

Preferably, the bath temperature during this process step is slightly elevated from conventional, such as about within a range of about 140° F. to about 180° F., more preferably from about 150° F. to about 170° F., and most preferably about 160° F., although the temperature can vary over a wide range depending on concentration and pH. Furthermore , the bath pH is preferably about 9 to about 12, more preferably from about 10 to about 11, and most preferably about 10.5. A cleaning bath of either sodium or potassium hydroxide at a pH of 10.5 has been found to be particularly effective when applied at a temperature of 160° F.

A cleaning bath is typically an aqueous solution of a cleaning agent and, optionally, at least one surfactant and at least one builder, which functions as a source of alkali and as a dispersant. Exemplary builders are soda ash or a tripolyphosphate. Similarly, a wide variety of surfactants may be used in the cleaning bath, such as the surfactants disclosed in U.S. Pat. No. 4,370,173 to Dollman. A sequestrant, such as sodium gluconate, may also be included to soften the water by holding calcium and magnesium.

The cleaning bath cleans the metal surface by removing oil and other contaminants from the metal surface. It is believed that this cleaning bath is particularly effective at removing the loose impurities and surface soils. It is also believed that this cleaning bath serves to protect the magnesium from being etched significantly. Thus, the cleaning bath removes certain die casting surface impurities.

A magnesium die casting which has been contacted by an alkaline cleaning solution is referred to herein as a "cleaned magnesium die casting." It is cleaned in the sense it has been exposed to the alkaline cleaning bath. It is not completely cleaned, however, in the sense that substantially all of the die casting impurities have been removed such that it is ready to be exposed to a pretreatment bath. Only after it is rinsed with water, then pickled, then rinsed again can it be viewed as fully cleaned and ready to be contacted with a pretreatment bath (i.e., substantially all of the die casting impurities are, by that point, removed).

The two water rinse steps are conventional water rinse steps, preferably using deionized water. The use of deionized water avoids the introduction of any deleterious ions, such as chloride ions, into the system.

After the first water rinse stage, the rinsed magnesium die casting is pickled, namely contacted with a second bath which is an aqueous hydroxy acetic acid solution. An aqueous hydroxy acetic acid solution sold under the trademark BULK KLEEN™ 695RMA by Bulk Chemicals has been found particularly effective. As with the cleaning bath, parameters such as concentration, bath temperature, and bath pH are all interrelated. Preferably, the bath temperature during this process step is about 70° F. to about 150° F., preferably 90° F. to about 120° F., although the temperature can vary over a wide range depending on concentration and pH. Furthermore, the bath pH is preferably about 2 to 6, more preferably 2.5 to 5.0, and most preferably to about 3.0 to about 5.0, depending on the magnesium alloy. An aqueous hydroxy acetic bath having pH of 3.5 has been found to particularly effective when applied at a temperature of about 110° F.

Other optional additives to the pickling bath include surfactants. It has been found that fluosurfactants serve to unexpectedly increase the etch rate. It is desirable to remove some of the metal during pickling to expose a more pure surface. Thus, the etch rate can be increased significantly by adding such fluosurfactants to the pickling bath.

The pickling bath cleans the metal surface further by removing certain contaminants from the metal surface. It is believed that the pickling bath is particularly effective at etching and desmutting oxides and hydroxides of aluminum and other alloying elements which the cleaning bath did not fully remove. In this way, the two stages together, both the pickling bath and the alkaline cleaning bath, serve to substantially remove all of the die casting impurities, without unduly etching the metal itself. Another benefit is that no caustic acid, with its associated problems, is needed to clean the magnesium die castings. After exposure to the pickling bath, the magnesium die casting is defined as "pickled."

The pickled magnesium die casting then undergoes another water rinse stage, identical to stage 2). After rinsing, the rinsed, pickled magnesium die casting is then contacted with a third bath which is a chrome-free pretreatment. The third bath of the present invention may be any number of known chrome-free pretreatments. As used herein, the term "chrome-free pretreatment" means any aqueous solution which improves the paint adhesion and corrosion resistance of a metal surface and which does not include chromium in any form. Some exemplary chrome-free pretreatments which can be used in connection with the present invention include an aqueous organo-functional silane and a polymer system having hydroxyl and carboxylic functional groups along with compound of a group IV-B element.

As used in this application, the term "silane" has the same meaning as defined in U.S. Pat. No. 5,393,353 to Bishop, which is incorporated herein by reference. The term "organo-functional silane" means a silane which includes an organic group (such as an alkyl, an aryl or an alkoxy group) and a functional group which serves to bond with or assist in bonding with polymers in the pretreatment or paint. Such functional groups include, but are not limited to, amino, epoxy, vinyl, and mercapto groups. Some exemplary organo-functional silanes which can be used in connection with the present invention include aminopropyltriethoxy silanes, mercapto silanes, and epoxy silanes, although any compatible, commercially available organo-functional silane is suitable. The third bath can be made by mixing the selected organo-functional silane with water.

An exemplary chrome-free pretreatment which may be used in connection with the present invention is the composition of Bulk Chemicals' U.S. Pat. No. 5,859,106, issued on Jan. 12, 1999, and entitled A METHOD AND COMPOSITION FOR TREATING METAL SURFACES, which is incorporated herein by reference. The preferred chrome-free pretreatment of the present invention is defined in the '106 patent as a polymer system having a plurality of hydroxyl and carboxylic functional groups and a compound containing a group IV-B element. The polymer system can be formed by mixing polyacrylic acid and polyvinyl alcohol.

Such compounds containing a group IV-B element typically include acids or salts of Group IV-B elements. Such acids include fluozirconic acid ($H_2ZrF_6$), fluotitanic acid ($H_2TiF_6$), and fluohafnic acid ($H_2HfF_6$). An exemplary salt of a Group IV-B element is ammonium zirconium carbonate. An ammonium zirconium carbonate solution sold by Magnesium Elektron Inc. under the trademark BACOTE 20, having a working empirical formula of $(NH_4)_2[Zr(OH)_2(CO_3)_2]+nH_2O$, may be used in connection with the present invention.

Another exemplary chrome-free pretreatment is the composition disclosed in Table 2 of the '106 patent, which is an aqueous solution of polyacrylic acid, ammonium bifluoride, and a fluosurfactant. Still another exemplary chrome-free pretreatment is the pretreatment disclosed in U.S. Pat. No. 5,129,967 to Sander et al., which includes dihydrohexafluozirconic acid, dihydrohexafluotitanic acid, polyacrylic acid, and hydrofluoric acid.

As with the first two baths, the concentration, bath temperature, and bath pH are all interrelated. Preferably, the bath temperature during this process step is about 70° F. to about 150° F., although the temperature can vary over a wide range depending on concentration and pH. The bath pH depends on the particular pretreatment used. A bath using a silane-based pretreatment sold under the trademark E-CLPS® by Bulk Chemicals at a concentration of about 20 grams/liter and a pH of about 8 has been found to particularly effective when applied at a temperature of about 90° F.

After pretreatment, the casting is preferably then dried (e.g., by an oven). Then, a decorative coating is applied to the dried magnesium die casting. A decorative coating might include a paint, such as a powdered paint sold by TCI of Georgia. No rinsing occurs between the steps of contacting the rinsed, pickled magnesium die casting with the third bath and applying the decorative coating. In this way, the generation of waste is minimized.

The time of treatment of a metal surface with the baths of the various steps need only be long enough to ensure complete wetting of the surface and can be as long as thirty minutes. The contact time between a substrate and solution should preferably be from approximately less than one second to about one minute. Treatment time is yet another factor interrelated with concentration, pH, and temperature.

In sum, the present invention provides an environmentally friendly process for treating magnesium die castings, while still maintaining excellent paint adhesion and corrosion resistance. More particularly, the present invention avoids the use of chromium, and its associated health hazards and disposal problems. Moreover, the present invention utilizes a non-caustic hydroxy acetic acid solution, which is easier to handle and dispose of than the caustic acids used in the prior art.

EXAMPLES

The following examples are included to more clearly demonstrate the overall nature of the invention. These examples are exemplary, not restrictive, of the invention.

Four AZ91 magnesium die castings were treated by three processes according to the present invention and one comparative process. Each treated magnesium die casting was then subjected to a salt spray resistance test as specified in Ford Laboratory Test Methods, specification FLTM BI 103-I. This method is used to test the resistance to salt spray of painted panels and parts. A salt spray cabinet and its operating conditions meet the requirements of ASTM B 117. The scriber is a carbide dipped scriber and the tape used is No. 898 from Minnesota Mining and Manufacturing Co. The test procedure involves scribing two diagonal lines from corner to corner, penetrating to the zinc coating, then placing the scribed panel in a salt spray cabinet. The panels are then rinsed with water, dried, and examined within fifteen minutes. The maximum corrosion and blister creapage is measured (in mm) from either side of the scribed lines. The panels are also examined for occurrence of surface blisters giving size and density according to ASTM D 714 (i.e., field rating).

Tape is applied over the scribed line, in a parallel direction, using firm finger pressure to ensure contact with the panel surface. The tape is then removed within ninety seconds of application by pulling back rapidly at as close to an angle of 180° to the panel as possible.

In all of the examples below, the magnesium die castings were first washed in a potassium hydroxide aqueous bath having a pH of about 10.5 at a temperature of about 160° F. The castings were then rinsed in deionized water followed by a pickling step in an aqueous hydroxy acetic acid solution, having pH of about 3.5 at about 75° F. The magnesium die castings were again rinsed in deionized water. In Examples 1 and 2, as shown in Table 1 below, the further rinsed die castings were then exposed to a solution containing an aminopropyltriethoxy silane sold under the trademark E-CLPS® 2400 by Bulk Chemicals, at a concentration of about 20 grams per liter and a temperature of about 90° F. In Example 3, the further rinsed die casting was exposed to an aqueous bath of fluotitanic acid, ammonium hydroxide, and a polymer blend of polyacrylic acid and polyvinyl alcohol as described in Bulk Chemicals' '106 patent.

The results of each of the four examples is shown below in Table 1.

TABLE 1

| Rating | Example 1 | Example 2 | Example 3 | Example 4 |
|---|---|---|---|---|
| Overall | Pass | Pass | Fail | Fail |
| Scribe | 0.5 mm failure @ 1000 hrs. | 0 mm failure @ 1000 hrs. | 5 mm failure @ 750 hrs. | 5 mm failure @ 1000 hrs. |
| Field | 1% failure @ 1000 hrs. | 1% failure @ 1000 hrs. | 3% failure @ 1000 hrs. | 1 failure @ 500 hrs. |

The overall rating of pass or fail is determined if there are more than three millimeters from the scribe. Also, in order to pass, there must be no corrosion spots, blistering, chipping, peeling, or gloss or adhesion loss.

As can be seen, the preferred embodiment of the present invention appears to be the use of a silane-based bath, which performed superior to the use of a polymeric blend of PVA and PAA (Example 3). The failure of Example 3 and the poor performance in the scribe test, particularly when compared with Example 4, is somewhat surprising and believed to be somewhat anomalous.

Both Examples 1 and 2, as can be seen from Table 1, performed quite well in the scribe test and each only had 1% failure at 1000 hours in the field test.

Although illustrated and described herein with reference to certain specific embodiments and examples, the present invention is nevertheless not intended to be limited to the details shown. Rather, the claims should be read to include various modifications within the scope and range of equivalents of the claims, without departing from the spirit of the invention.

What is claimed is:

1. A method for treating a magnesium die casting to improve corrosion resistance of the magnesium die casting, said method comprising the steps of:

contacting the magnesium die casting with a first bath comprising an alkaline cleaning solution to form a cleaned magnesium die casting;

rinsing said cleaned magnesium die casting with water to form a rinsed magnesium die casting;

contacting said rinsed magnesium die casting with a second bath consisting essentially of an aqueous hydroxy acetic acid solution to form a pickled magnesium die casting;

rinsing said pickled magnesium die casting with water to form a rinsed, pickled magnesium die casting; and contacting said rinsed, pickled magnesium die casting with a third bath comprising a chrome-free pretreatment.

2. The method in accordance with claim 1, wherein the pH of said second bath is about 3.5 to about 5.0.

3. The method in accordance with claim 1, wherein said alkaline cleaning solution is an aqueous solution of an alkaline cleaning agent.

4. The method in accordance with claim 3, wherein said alkaline cleaning agent is selected from the group consisting of sodium hydroxide and potassium hydroxide.

5. The method in accordance with claim 1, wherein the pH of said first bath is about 10.2 to about 10.8.

6. The method in accordance with claim 5, wherein the pH of said first bath is about 10.5.

7. The method in accordance with claim 1, wherein the temperature of said alkaline cleaning solution is at least about 160° F.

8. The method in accordance with claim 1, wherein said chrome-free pretreatment is an aqueous solution containing an organofunctional silane selected from the group consisting of an aminopropyltriethoxy silane, a mercapto silane, and an epoxy silane.

9. The method in accordance with claim 1, wherein said chrome-free pretreatment is a polymer system having hydroxyl and carboxylic functional groups and a compound of a group IV-B element.

10. The method in accordance with claim 1 further comprising, after the step of contacting said rinsed, pickled magnesium die casting with said third bath, drying said magnesium die casting and applying a decorative coating on said dried magnesium die casting, without rinsing between the steps of contacting said rinsed, pickled magnesium die casting with the third bath applying the decorative coating.

11. A method for treating a magnesium die casting to improve corrosion resistance of the magnesium die casting, said method comprising the steps of:

contacting the magnesium die casting with a first bath, having a pH of from about 10.2 to about 10.8 and comprising an alkaline cleaning solution consisting of water and an alkaline cleaning agent selected from the group consisting of sodium hydroxide and potassium hydroxide to form a cleaned magnesium die casting;

rinsing said cleaned magnesium die casting with water to form a rinsed magnesium die casting;

contacting said rinsed magnesium die casting with a second bath, having a pH of from about 3.5 to about 5.0 and consisting essentially of an aqueous hydroxy acetic acid solution to form a pickled magnesium die casting;

rinsing said pickled magnesium die casting with water to form a rinsed, pickled magnesium die casting; and contacting said rinsed, pickled magnesium die casting with a third bath comprising a chrome-free pretreatment selected from the group consisting of an aqueous organofunctional silane solution and an aqueous polymeric system having hydroxyl and carboxylic functional groups along with a compound of a group IV-B element, to form a pretreated magnesium die casting.

12. The method in accordance with claim 11 further comprising drying said pretreated magnesium die casting and applying a decorative coating on said dried magnesium die casting, without rinsing between the steps of contacting said rinsed, pickled magnesium die casting with the third bath and applying the decorative coating.

13. The method in accordance with claim 11, wherein the step of contacting the magnesium die casting with the first bath is done at a temperature of at least about 160° F.

14. In a method for treating magnesium die castings including cleaning and applying a pretreatment to the magnesium die castings to improve corrosion resistance and paint adhesion of the magnesium die castings, the improvement comprising contacting the magnesium die castings with a pickling bath consisting essentially of an aqueous hydroxy acetic acid solution.

15. In a method for treating magnesium die castings including cleaning and applying a pretreatment to the magnesium die castings to improve corrosion resistance and paint adhesion of the magnesium die castings, the improvement comprising contacting the magnesium die castings with a pickling bath consisting essentially of an aqueous hydroxy acetic acid solution and at least one surfactant.

* * * * *